US007034239B2

(12) United States Patent
Miyako

(10) Patent No.: US 7,034,239 B2
(45) Date of Patent: Apr. 25, 2006

(54) SWITCH CONTACT STRUCTURE AND METHOD FOR MANUFACTURING SWITCH CONTACT

(75) Inventor: Mamoru Miyako, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 10/898,831

(22) Filed: Jul. 26, 2004

(65) Prior Publication Data

US 2005/0023123 A1 Feb. 3, 2005

(30) Foreign Application Priority Data

Jul. 30, 2003 (JP) ..... 2003-282752
Jun. 29, 2004 (JP) ..... 2004-191780

(51) Int. Cl.
*H01H 1/10* (2006.01)

(52) U.S. Cl. ..... 200/512; 200/520; 200/341

(58) Field of Classification Search ..... 200/511–513, 200/520, 5 A, 341, 329
See application file for complete search history.

(56) References Cited

U.S. PATENT DOCUMENTS 4,164,634 A 8/1979 Gilano
4,839,474 A * 6/1989 Hayes-Pankhurst et al. 200/5 A
5,561,278 A * 10/1996 Rutten ..... 200/5 A
5,905,235 A * 5/1999 Charman ..... 200/5 A
6,326,571 B1 * 12/2001 Kitamura et al. ..... 200/520

FOREIGN PATENT DOCUMENTS

JP 57-109532 7/1982
JP 2001-126565 5/2001

* cited by examiner

*Primary Examiner*—K. Lee
(74) *Attorney, Agent, or Firm*—Crompton, Seager & Tufte, LLC

(57) ABSTRACT

A contact structure for a switch that ensures stable electrical connection. The contact structure includes a substrate. A first fixed contact and a second fixed contact are arranged on the substrate and spaced from each other. An elastically deformable movable contact engages and disengages the first and second fixed contacts. The movable contact includes a recess. A conductive member is arranged on the movable contact for electrically connecting the first and second fixed contacts when the movable contact engages the first and second fixed contacts.

17 Claims, 5 Drawing Sheets

SWITCH CONTACT STRUCTURE AND METHOD FOR MANUFACTURING SWITCH CONTACT

BACKGROUND OF THE INVENTION

The present invention relates to a contact structure for a switch and a method for manufacturing a switch contact.

A switch known in the prior art has a contact structure including a fixed contact, which is arranged on a substrate, and a movable contact opposing the fixed contact. The movable contact is engaged with and disengaged from the fixed contact when the switch performs a switching operation. In the contact structure of this switch, a foreign material may get caught between the fixed contact and the movable contact. This may obstruct the engagement of the movable contact with the fixed contact and thus impede the flow of current between the movable and fixed contacts.

To solve this problem, Japanese Laid-Open Patent Publication No. 2001-126565 describes a contact structure for a switch that uses a movable contact formed by a rubber member. A conductive film is applied to both upper and lower surfaces of the rubber member. Metal wires connecting the conductive films are embedded in the rubber member. When there is a layer of foreign material between the fixed contact and the movable contact, the metal wires penetrate the foreign material layer and contact the fixed contact. Thus, the metal wires stably ensure electrical connection between the fixed contact and the movable contact.

The metal wires penetrate foreign material layers deposited on the fixed contact and ensure electrical connection between the fixed and movable contacts. However, once a layer of foreign material is deposited on the fixed contact, the metal wires would have to penetrate the foreign material layer whenever force is applied to the metal wires of the movable contact. This would cause wear of the metal wires and decrease durability. Further, the amount of foreign material deposited on the fixed contact may increase. This would increase the thickness of the foreign material layer deposited on the fixed contact. When the thickness exceeds a certain value, the metal wires would not be able to penetrate the foreign material layer. In such a case, normal switching operations cannot be performed.

SUMMARY OF THE INVENTION

It is an object of the present invention to provide a contact structure for a switch that ensures stable electrical connection.

One aspect of the present invention is a contact structure for a switch including a substrate, a first fixed contact and a second fixed contact arranged on the substrate spaced from each other, and an elastically deformable movable contact for engaging and disengaging the first and second fixed contacts. The movable contact includes a recess. A conductive member is arranged on the movable contact for electrically connecting the first and second fixed contacts when the movable contact engages the first and second fixed contacts.

A further aspect of the present invention is a method for manufacturing a contact for a switch. The switch includes a substrate and a first fixed contact and a second fixed contact arranged on the substrate spaced from each other. The method includes preparing an elongated elastic member, forming a recess in a surface of the elongated elastic member in the longitudinal direction of the elastic member, laying out a conductive member in the recess in a direction perpendicular to the longitudinal direction of the elastic member, and cutting the elastic member in a direction perpendicular to the longitudinal direction. The method further includes molding a piece of the elastic member resulting from the cutting with the switch to form the contact for engaging the fixed contacts and electrically connecting them to one another via the conductive member and disengaging from the fixed contacts to electrically disconnect them from one another.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1A:
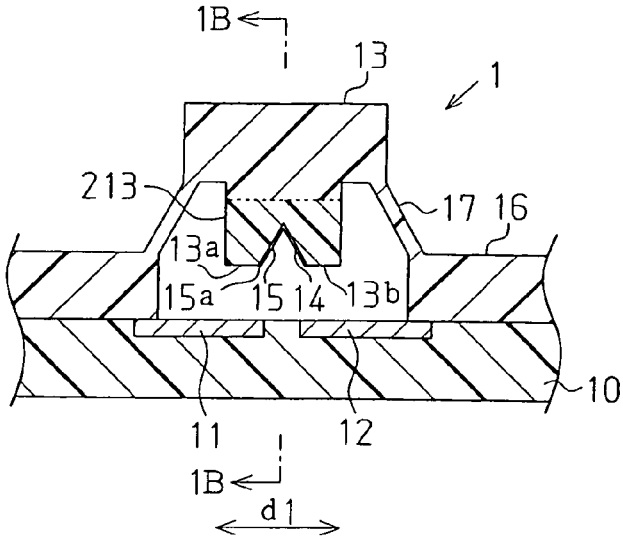
FIG. 1A is a cross-sectional view showing a contact structure for a switch according to a first embodiment of the present invention.

A switch 1 according to a first embodiment of the present invention will now be described. Referring to FIG. 1A, the switch 1 includes an insulator 10, or a substrate. A first fixed contact 11 and a second fixed contact 12, which are spaced from each other, are arranged on the insulator 10. A movable contact 13 is opposed to the first and second fixed contacts 11 and 12. The movable contact 13 engages the first and second fixed contacts 11 and 12. This electrically connects the first and second fixed contacts 11 and 12.

A support 16 is arranged on the upper surface of the insulator 10 to support the movable contact 13, which has a generally block-like shape, with a flexible portion 17. The support 16, the flexible portion 17, and the movable contact 13 are formed integrally from synthetic resin so as to enable elastic deformation when force is applied to the movable contact 13. When a downward force is applied to the movable contact 13 as viewed in the state of FIG. 1A, the flexible portion 17 flexes so that the movable contact 13 is moved downward. When the force is released, the movable contact 13 returns to its original position. This enables the movable contact 13 to be engaged with and disengaged from the first and second fixed contacts 11 and 12. The movable contact 13 has a contact portion 213 including a first contact surface 13*a* and a second contact surface 13*b*. When force is applied to the movable contact 13, the first contact surface 13*a* contacts the first fixed contact 11, and the second contact surface 13*b* contacts the second fixed contact 12. A recess 14 separating the first contact surface 13*a* and the second contact surface 13*b* is formed in the movable contact 13.

Figure 1B:
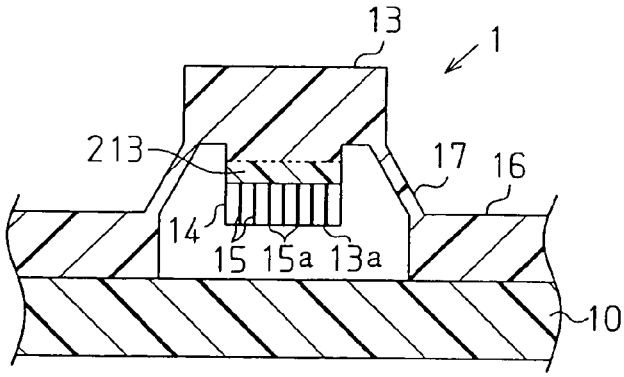
FIG. 1B is a cross-sectional view taken along line 1B—1B in FIG. 1A.
Figure 1C:
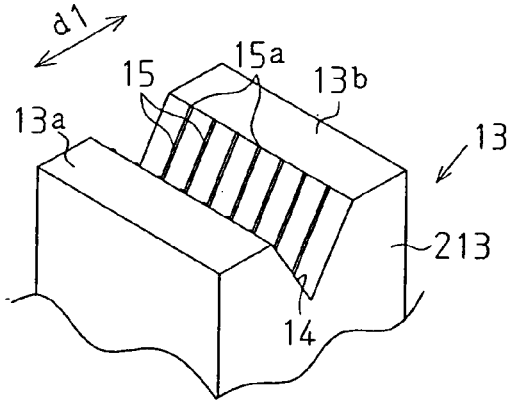
FIG. 1C is a perspective view showing a movable contact of the switch shown in FIG. 1A.

As shown in FIGS. 1A to 1C, metal wires 15, which serve as conductive members, are arranged on the movable contact 13. Each metal wire 15 extends along the movable contact 13 between the first contact surface 13*a*, which contacts the first fixed contact 11, and the second contact surface 13*b*, which contacts the second fixed contact 12. That is, each metal wire 15 extends in a connection direction d1 as indicated by the arrows in FIGS. 1A and 1C. Each metal wire 15 has two ends 15*a*, one of which is substantially flush with the first contact surface 13*a* and the other of which is substantially flush with the second contact surface 13*b*. Thus, when the movable contact 13 is engaged with the first and second fixed contacts 11 and 12, the ends 15*a* of the wires 15 contact the first and second fixed contacts 11 and 12. The metal wires 15 are formed by plating wires made of metal such as stainless steel or beryllium copper with silver, gold, or the like.

Figure 2:
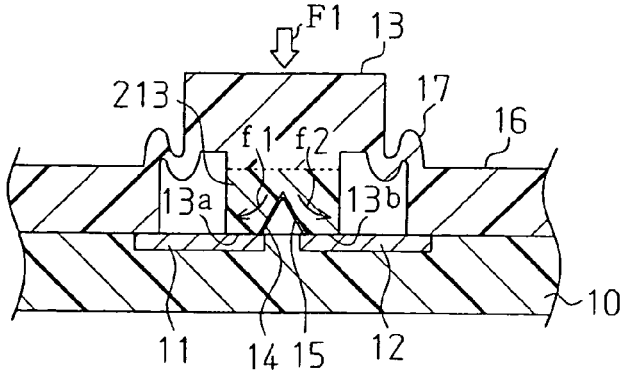
FIG. 2 is a cross-sectional view showing the operation of the switch shown in FIG. 1.

The operation of the switch 1 will now be discussed. Referring to FIG. 2, when a downward pushing force F1 is applied to the movable contact 13 as viewed in the drawing, the flexible portion 17 flexes and moves the movable contact 13 downward. Then, the first contact surface 13*a* of the movable contact 13 contacts the first fixed contact 11, and the second contact surface 13*b* contacts the second fixed contact 12. Further, the recess 14 of the movable contact 13 is widened. This produces deformation forces f1 and f2 in the movable contact 13 that act to separate the portion near the movable first contact surface 13*a* and the portion near the second contact surface 13*b* from each other. In this manner, the movable contact 13 is elastically deformed so that the first contact surface 13*a* and the second contact surface 13*b* move away from each other.

In this state, the ends 15*a* of the metal wires 15 arranged in the movable contact 13 contact the first and second fixed contacts 11 and 12. The movable contact 13 is elastically deformed so that the first contact surface 13*a* and the second contact surface 13*b* move away from each other. This ensures that the metal wire ends 15*a*, which are substantially flush with the first and second contact surfaces 13*a* and 13*b*, contact the first and second fixed contacts 11 and 12. Further, while contacting the first and second fixed contacts 11 and 12, the wire ends 15*a* wipe foreign material off from the first and second fixed contacts 11 and 12. This also eliminates foreign material, which is produced by oxidization and which leads to deterioration, from the first and second fixed contacts 11 and 12.

One example of a process for manufacturing the movable contact 13 of the switch 1 will now be discussed. The other portions of the switch 1 are manufactured by performing known processes.

Figure 3A:
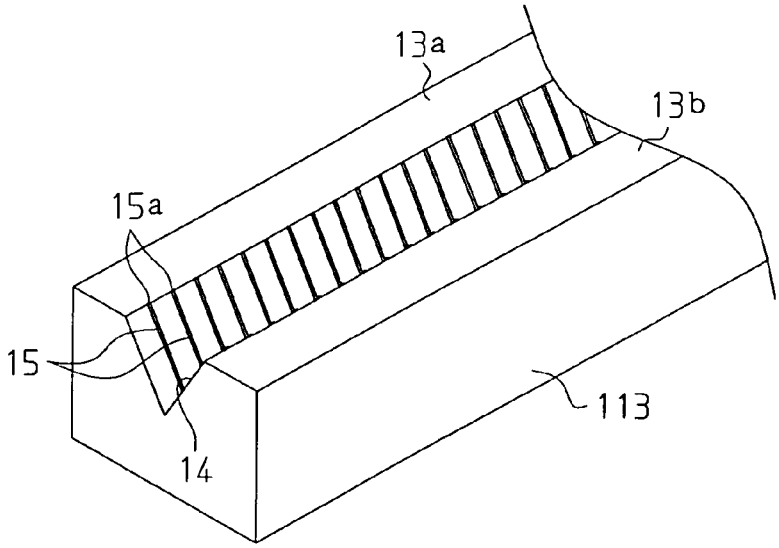
FIGS. 3A and 3B are perspective views and FIG. 3C is a cross-sectional view, with each view showing the procedures for manufacturing the movable contact of the switch shown in FIG. 1.

Referring to FIG. 3A, an elongated, block-shaped elastic member 113 is first formed from synthetic resin. Then, the recess 14, which has a V-shaped cross-section, is formed in one surface of the elastic member 113. The recess 14 extends in the longitudinal direction of the elastic member 113. The first contact surface 13*a* and the second contact surface 13*b* are defined on opposite sides of the recess 14.

The metal wires 15 are adhered to the walls of the recess 14 with an adhesive or the like so that the metal wires 15 extend in a direction perpendicular to the longitudinal direction of the elastic member 113, that is, in the connection direction d1 (metal wire layout step). The metal wires 15 are laid out so that their ends 15*a* are flush with the corresponding contact surfaces 13*a* and 13*b*.

Figure 3B:
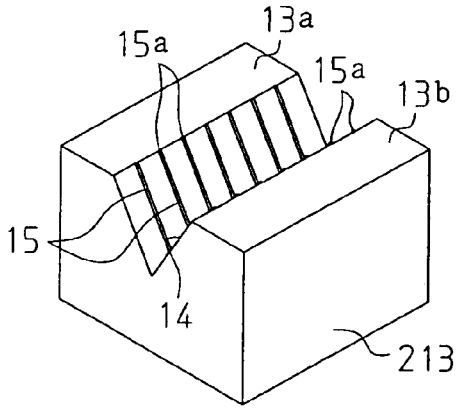
Figure 3C:
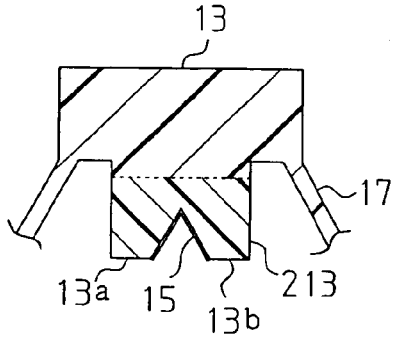

Then, the elastic member 113 is cut, parallel to the connection direction d1, into certain lengths (cutting step) to form a plurality of contact portions 213. One contact portion 213 is shown in FIG. 3B. Subsequently, referring to FIG. 3C, the contact portion 213 is integrally insert-molded with the movable contact 13 (movable contact molding step). This forms the movable contact 13 of the switch 1.

The advantages of the first embodiment will now be described.

(1) The movable contact 13 of the switch 1 includes the first contact surface 13*a*, which contacts the first fixed contact 11, the second contact surface 13*b*, which contacts the second fixed contact 12, and the recess 14, which separates the first and second contact surfaces 13*a* and 13*b*. Thus, when the movable contact 13 contacts the first and second fixed contacts 11 and 12, which are spaced from each other on the insulator 10, the first and second fixed contacts 11 and 12 are electrically connected to each other by the metal wires 15 of the movable contact 13. Further, the first and second contact surfaces 13*a* and 13*b* wipe foreign material off from the first and second fixed contacts 11 and 12. More specifically, the movable contact 13 is elastically deformable, and the recess 14 separates the first and second contact surfaces 13*a* and 13*b*. Thus, when the movable contact 13 is pushed toward the first and second fixed contacts 11 and 12, the movable contact 13 first engages the first and second fixed contacts 11 and 12. Then, the recess 14 is widened so as to move the first and second contact surfaces 13*a* and 13*b* away from each other. This deformation of the movable contact 13 causes the first and second contact surfaces 13*a* and 13*b* to slide along and wipe the first and second fixed contacts 11 and 12. Accordingly, stable electrical connection is ensured between the first fixed contact 11, the second fixed contact 12, and the movable contact 13, which form the contact structure of the switch 1.

(2) In the switch 1, the metal wires 15 function as conductive members that electrically connect the first fixed contact 11 and the second fixed contact 12. This enables smooth flexing of the movable contact 13 when force is applied to the movable contact 13 in a state contacting the first and second fixed contacts 11 and 12.

(3) The metal wires 15 are laid out so that contact between their ends 15*a* and the first fixed contact 11 or the second fixed contact 12 is ensured. This further stabilizes electrical connection between the first and second fixed contacts 11 and 12. Further, the ends 15*a* of the metal wires 15 wipe the surfaces of the first and fixed contacts 11 and 12 in a satisfactory manner. This removes foreign material from the surface of the first and second fixed contacts 11 and 12. Foreign material includes material formed by deterioration of the surfaces of the first and second fixed contacts 11 and 12 caused by, for example, the oxidization of grease. As a result, a coating for protecting the surface of the first and second fixed contacts 11 and 12 is not necessary. This saves costs.

(4) When manufacturing the switch 1, the process for producing the movable contact 13 includes the metal wire layout step, the cutting step, and the movable contact molding step. In the metal wire layout step, metal wires 15 are arranged on at least one surface of an elongated elastic member 113 in a direction perpendicular to the longitudinal direction of the elastic member 113. In the cutting step, the elastic member 113 is cut in the direction perpendicular to the longitudinal direction of the elastic member 113. In the movable contact molding step, a movable contact portion 213 that is cut out in the cutting step is molded integrally with the movable contact 13 so that the contact portion 213 contacts the first and second fixed contacts 11 and 12. In this manner, by laying out metal wires 15 in a direction perpendicular to the longitudinal direction of the elongated elastic member 113, and then cutting the elongated elastic member 113 in a direction perpendicular to the longitudinal direction (in the layout direction of the metal wires 15), a plurality of contact portions 213, for use with the movable contact 13, are manufactured.

Figure 4:
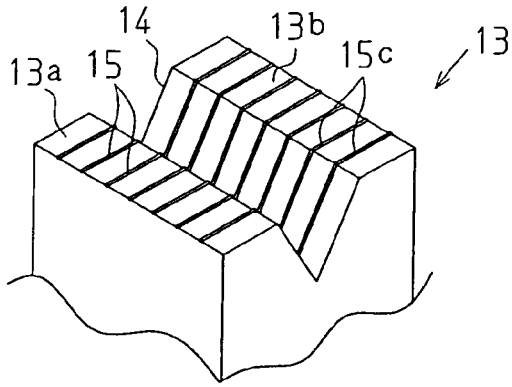
FIG. 4 is a perspective view showing a movable contact according to a second embodiment of the present invention.

In the first embodiment, the ends 15*a* of the metal wires 15 are substantially flush with the first and second contact surfaces 13*a* and 13*b* so that when the movable contact 13 is pushed, the ends 15*a* contact and connect the first and second fixed contacts 11 and 12. However, the metal wires 15 do not have to be laid out on the movable contact in such a manner. For example, in a second embodiment of the present invention, as shown in FIG. 4, the metal wires 15 may also be laid out on the first and second contact surfaces 13*a* and 13*b*. The metal wires 15 have extended portions 15*c* having a predetermined length that extend along the first and second contact surfaces 13*a* and 13*b*. In this structure, all of the. extended portions 15*c* wipe the surfaces of the first and second fixed contacts 11 and 12. This reduces wear of the metal wires 15 arranged on the movable contact 13 and improves the durability of the contact structure for the switch 1.

Figure 5:
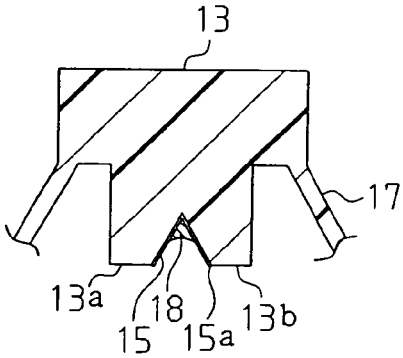
FIG. 5 is a cross-sectional view showing a movable contact according to a third embodiment of the present invention.

In the first embodiment, the metal wires 15 are adhered to the surface of the movable contact 13 by an adhesive or the like. However, the metal wires 15 do not have to be attached to the movable contact 13 in such a manner. For example, in a third embodiment of the present invention, as shown in FIG. 5, part of the metal wires 15 may be embedded in a protective layer 18. The protective layer 18 is formed by applying silicon rubber, elastomer, or the like in the recess 14 of the movable contact 13. The protective layer 18 protects the metal wires 15 and prevents the metal wires 15 from falling off the movable contact 13. Further, the protective layer 18 prevents the metal wires 15 from being damaged. Thus, the protective layer 18 improves the durability of the movable contact 13.

Figure 6A:
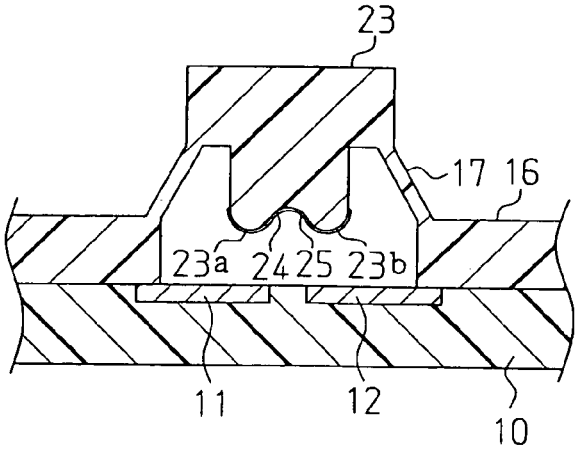
FIG. 6A is a cross-sectional view showing a movable contact according to a fourth embodiment of the present invention.
Figure 6B:
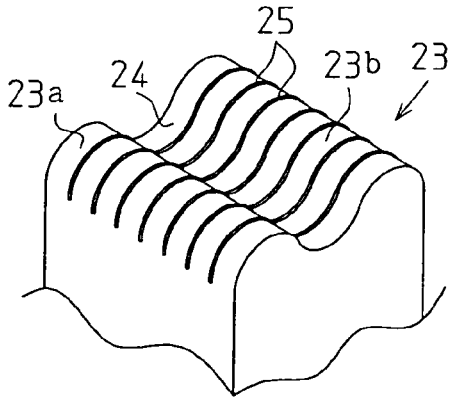
FIG. 6B is a perspective view showing the movable contact of FIG. 6A.
Figure 7:
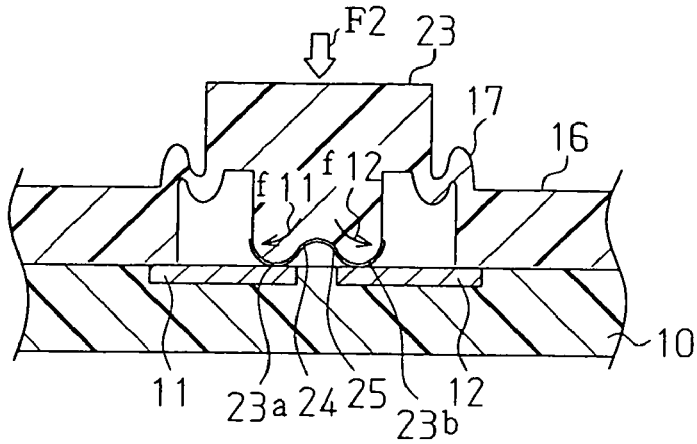
FIG. 7 is a cross-sectional view showing the operation of the movable contact shown in FIG. 6A.

In the first embodiment, the movable contact 13 is generally block-shaped and has the recess 14 with a V-shaped cross-section to define the first and second contact surfaces 13*a* and 13*b*. However, the movable contact 13 is not limited to such a shape. For example, in a fourth embodiment of the present invention, as shown in FIGS. 6A and 6B, first and second contact surfaces 23*a* and 23*b*, which correspond to the first and second contact surfaces 13*a* and 13*b* of the first embodiment, may be curved. Further, a recess 24, which corresponds to the recess 14 of the first embodiment, may be curved. Referring to FIG. 7, in this structure, the application of a pushing force F2 to the movable contact 23 produce deformation forces f11 and f12 that act on the first and second contact surfaces 23*a* and 23*b* when the first and second contact surfaces 23*a* and 23*b* respectively contact the first and second fixed contacts 11 and 12. The deformation forces f11 and f12 elastically deform the first and second contact surfaces 23*a* and 23*b* as they slide along the surfaces of the first and second fixed contacts 11 and 12. This wipes foreign material off from the first and second fixed contacts 11 and 12 in a satisfactory manner.

Figure 8A:
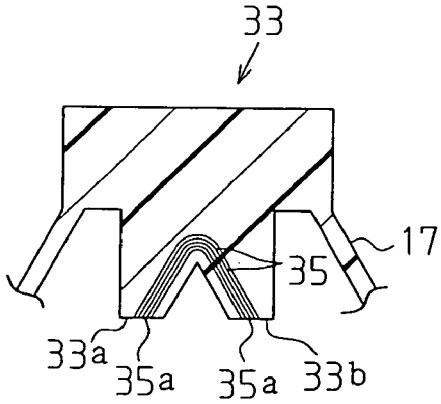
FIG. 8A is a cross-sectional view showing a movable contact according to a fifth embodiment of the present invention.
Figure 8B:
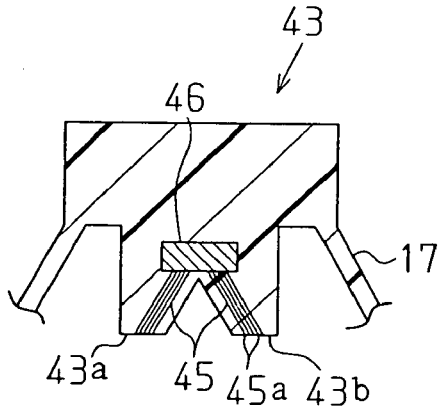
FIG. 8B is a cross-sectional view showing a movable contact according to a sixth embodiment of the present invention.
Figure 8C:
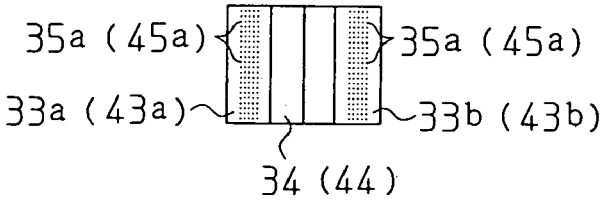
FIG. 8C is a bottom view showing the movable contacts of FIG. 8A and FIG. 8B.

In the first embodiment, the metal wires 15 are laid out in a single row on the surface of the movable contact 13 in the direction connecting the first and second fixed contacts 11 and 12 (connection direction d1). However, the metal wires 15 are not limited to such a layout. For example, referring to FIG. 8A, in a fifth embodiment of the present invention, metal wires 35 may be laid out in rows in a superimposed manner and be embedded in a recess 34 of a movable contact 33. In this case, the ends 35*a* of the metal wires 35 are exposed from first and second contact surfaces 33*a* and 33*b* of the movable contact 33 as shown in FIG. 8C. This ensures electrical connection between the first and second fixed contacts 11 and 12 when the movable contact 33 contacts the first and second fixed contacts 11 and 12.

In the first embodiment, the metal wires 15 function as conductive members arranged on the movable contact 13 that connect the first and second fixed contacts 11 and 12. However, the conductive members arranged on a movable contact are not limited to such a structure. For example, referring to FIG. 8B, in a sixth embodiment of the present invention, a metal plate 46 functioning as a conductive member may be used as a relay for metal wires 45. More specifically, metal wires 45 may be laid out in rows in a superimposed manner and be embedded in a recess 44 of a movable contact 43. In this case, the ends 45*a* of the metal wires 45 are exposed from first and second contact surfaces 43*a* and 43*b* of the movable contact 43 as shown in FIG. 8C. The metal plate 46 is arranged in the middle of the recess 44 to connect the metal wires 45. This structure also enables the portions of the movable contact 43 near the first and second contact surfaces 43*a* and 43*b* on each side of the metal plate 46 to smoothly flex and move away from each other. Thus, the surfaces of the first and second fixed contacts 11 and 12 are smoothly wiped.

In the first embodiment, the recess 14 is formed to separate the first and second contact surfaces 13*a* and 13*b*. However, the recess does not necessarily have to be formed. In other words, a movable contact may have first and second contact surfaces that are connected continuously to each other.

Figure 9A:
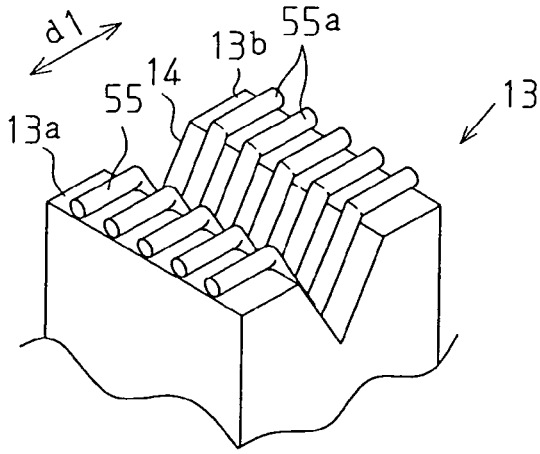
FIG. 9A is a perspective view showing a movable contact according to a seventh embodiment of the present invention.
Figure 9B:
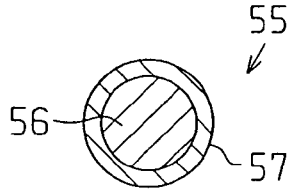
FIG. 9B is a cross-sectional view showing a metal wire used for the movable contact of FIG. 9A.

In a seventh embodiment of the present invention, referring to FIG. 9B, metal wires 55 are used in lieu of the metal wires 15 of the first embodiment. The metal wires 55 each include a copper wire 56. A gold plating 57 is applied to the surface of the copper wire 56. This structure improves the contact performance of the switch 1. In other words, the flow of current between the first and second fixed contacts 11 and 12 through the metal wires 55 is further stabilized. Further, the metal wires 55 have extended portions 55*a* extended for a predetermined length in the connection direction d1 of the first and second contact surfaces 13*a* and 13*b* as shown in FIG. 9A. If unnecessary, the extended portions 55*a* may be eliminated.

Figure 10:
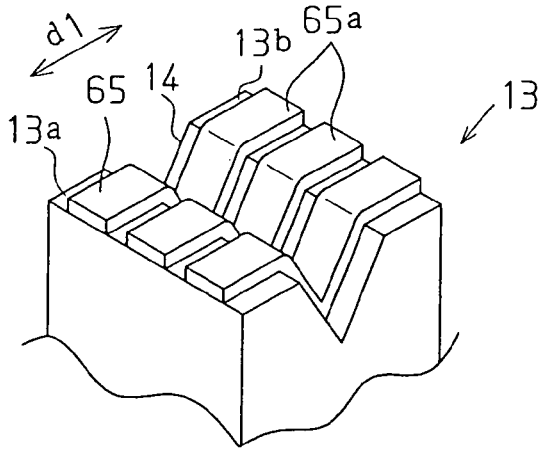
FIG. 10 is a perspective view showing a movable contact according to an eighth embodiment of the present invention.

In an eighth embodiment of the present invention, referring to FIG. 10, metal plates 65 are used in lieu of the metal wires 15. Each metal plate 65 is a metal foil having a thickness of approximately 0.1 to 0.2 mm or a thin metal plate having a thickness of approximately 0.2 to 0.4 mm. Further, the metal plate 65 has a predetermined width, which is the dimension of the metal plate 65 in the direction perpendicular to the connection direction d1. The metal plates 65 increase the area of contact with the first and second fixed contacts 11 and 12. Further, the metal plates 65 have extended portions 65*a* that extend in the connection direction d1 along the entire width of the first and second contact surfaces 13*a* and 13*b*. If unnecessary, the extended portions 65*a* may be eliminated.

It should be apparent to those skilled in the art that the present invention may be embodied in many other specific forms without departing from the spirit or scope of the invention. Therefore, the present examples and embodiments are to be considered as illustrative and not restrictive, and the invention is not to be limited to the details given herein, but may be modified within the scope and equivalence of the appended claims.

What is claimed is:

1. A contact structure for a switch comprising:

a substrate;

a first fixed contact and a second fixed contact arranged on the substrate spaced from each other;

an elastically deformable movable contact for engaging and disengaging the first and second fixed contacts, the movable contact including a recess, wherein the recess defines on the movable contact a first contact surface for engaging the first fixed contact and a second contact surface for engaging the second fixed contact and a conductive member arranged on the movable contact for electrically connecting the first and second fixed contacts when the movable contact engages the first and second fixed contacts, wherein the conductive member includes a portion that engages the first fixed contact and a portion that engages the second fixed contact when the movable contact engages the first and second fixed contacts, the conductive member being arranged along the recess.

2. The contact structure according to claim 1, wherein the conductive member is arranged on the first and second contact surfaces of the movable contact for a predetermined length.

3. The contact structure according to claim 1, wherein the conductive member is a metal wire.

4. The contact structure according to claim 3, wherein the metal wire is formed by applying gold plating to a copper wire.

5. The contact structure according to claim 1, wherein the conductive member is a metal foil or a thin metal plate.

6. The contact structure according to claim 5, wherein the metal foil or the thin metal plate has a thickness of approximately 0.1 to 0.4 mm.

7. The contact structure according to claim 1, wherein the recess is V-shaped.

8. The contact structure according to claim 7, wherein the recess includes a layer partially covering the conductive member.

9. The contact structure according to claim 1, wherein the conductive member is embedded in the movable contact so that the conductive member is exposed from at least part of the first and second contact surfaces.

10. The contact structure according to claim 9, wherein the conductive member includes a plurality of metal wires embedded in the movable contact in a superimposed manner.

11. The contact structure according to claim 9, wherein the conductive member includes a metal plate arranged in the recess, a metal wire extending from the metal plate to the first contact surface, a futher metal wire extending from the metal plate to the second contact surface.

12. The contact structure according to claim 1, wherein the first contact surface and the second contact surface are curved.

13. The contact structure according to claim 1, wherein the recess is curved.

14. A method for manufacturing a contact for a switch, the switch including a substrate and a first fixed contact and a second fixed contact arranged on the substrate spaced from each other, the method comprising:

preparing an elongated elastic member;

forming a recess in a surface of the elongated elastic member in the longitudinal direction of the elastic member;

laying out a conductive member in the recess in a direction perpendicular to the longitudinal direction of the elastic member;

cutting the elastic member in a direction perpendicular to the longitudinal direction; and molding a piece of the elastic member resulting from said cutting with the switch to form the contact for engaging the fixed contacts and electrically connecting them to one another via the conductive member and disengaging from the fixed contacts to electrically disconnect them from one another.

15. The method according to claim 14, wherein said forming a recess includes forming a V-shaped recess.

16. The method according to claim 14, wherein said laying out a conductive member includes laying out metal wires.

17. The method according to claim 14, wherein said laying out a conductive member includes laying out a metal foil or a thin metal plate.

* * * * *

UNITED STATES PATENT AND TRADEMARK OFFICE

CERTIFICATE OF CORRECTION

PATENT NO. : 7,034,239 B2
APPLICATION NO. : 10/898831
DATED : April 25, 2006
INVENTOR(S) : Mamoru Miyako It is certified that error appears in the above-identified patent and that said Letters Patent is hereby corrected as shown below:

Column 8
Line 20, delete “futher”, and insert therefor --further--.

Signed and Sealed this

Eighth Day of August, 2006

JON W. DUDAS
*Director of the United States Patent and Trademark Office*